United States Patent [19]

Smith

[11] 4,453,847

[45] Jun. 12, 1984

[54] RECORD CARRIER FEED ARRANGEMENT FOR A PRINTER

[75] Inventor: Henry E. Smith, Pleasanton, Calif.

[73] Assignee: Xerox Corporation, Stamford, Conn.

[21] Appl. No.: 418,347

[22] Filed: Sep. 15, 1982

[51] Int. Cl.[3] ..... B41J 13/20

[52] U.S. Cl. ..... 400/645.5; 400/639; 271/120; 226/91

[58] Field of Search ..... 400/636, 645, 639, 645.5, 400/639.1, 639.2, 616, 616.1, 616.2; 271/120, 178, 314, 272; 226/91, 92

[56] References Cited

U.S. PATENT DOCUMENTS

| | | | |
|---|---|---|---|
| 530,929 | 12/1894 | Crittenden | 400/639 |
| 1,280,678 | 10/1918 | Clamecy | 400/639 |
| 1,696,236 | 12/1928 | Helmend | 400/645.5 |
| 2,555,728 | 6/1951 | Bradt | 400/639 |
| 2,561,453 | 7/1951 | Von Duyke | 400/639.1 |
| 3,166,313 | 1/1965 | Rehn | 271/178 |
| 3,519,117 | 7/1970 | Smith | 400/639.1 |
| 3,630,516 | 12/1971 | Hong | 271/120 |
| 3,669,447 | 6/1972 | Turner et al. | 271/120 |
| 3,937,455 | 2/1976 | Hauser | 271/120 |
| 4,062,436 | 12/1977 | Kondur, Jr. et al. | 400/636 |
| 4,176,569 | 12/1979 | Deluca | 226/91 |
| 4,241,911 | 12/1980 | Lee | 400/636 |
| 4,379,646 | 4/1983 | Maeda | 400/636 |

*Primary Examiner*—William Pieprz
*Attorney, Agent, or Firm*—Serge Abend

[57] ABSTRACT

A feed arrangement for transporting a record carrier around and in intimate contact with a printing platen in a printer. The feed arrangement includes a rotatable guiding member in the form of a paddle wheel having a number of resilient blades mounted in interference relationship to the platen. The guiding member serves to capture the leading edge of the record carrier and redirect it toward and then urge it into intimate contact with the platen.

6 Claims, 6 Drawing Figures

RECORD CARRIER FEED ARRANGEMENT FOR A PRINTER

Figure 1:
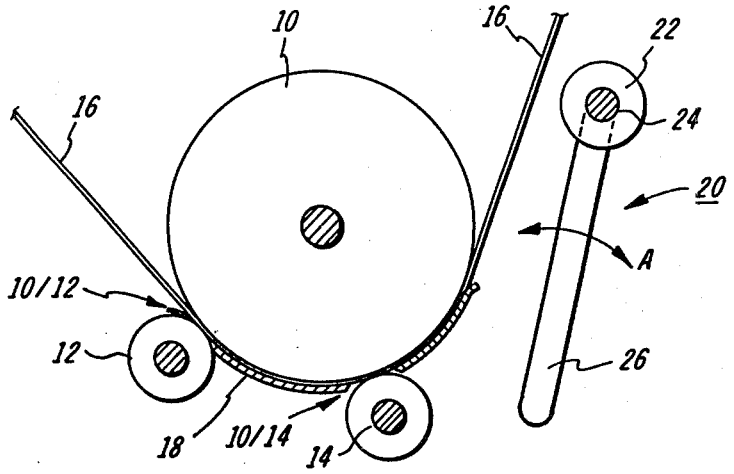
FIG. 1 (PRIOR ART)

The present invention relates to a feed arrangement for transporting record carriers, in the form of sheets of paper, into proper printing position in a printer and, more particularly, for advancing the sheets around a printing platen in intimate contact therewith. A rotating guiding member having deformable fingers or blades captures and redirects the lead edge of the sheets and sweeps the sheets into the desired intimate contact early in the paper feed cycle.

In conventional impact printers such as the daisy-wheel-type, there is generally provided a cylindrical platen around which the record carrier sheet is fed for supporting the sheet during impact thereon. Adjacent to the platen there is disposed a printing mechanism at a printing region and an inked ribbon positioned between the printing mechanism and the platen. In operation, a selected character on the printing mechanism impacts the inked ribbon and drives it against the sheet on the platen. It is essential, in order to obtain a clear and crisp impression of the printing character upon the sheet, that the sheet be held intimately against the platen in the printing region so that the sheet will have a firm base behind it, against which the printing character can be struck. It is also known that the presence of bulges or slacks regions in the sheet at the printing region will generate excessive noise as the sheet is initially impacted by the printing character followed by the printing character and the sheet together being driven into contact with the platen.

The proper feed of sheets into the printer must insure that the sheets are in intimate contact with the platen and that no bulges are present. This has been safisfactorily accomplished manually for many years, in typewriters which are operator controlled. It is common for the operator to manually feed the sheet into the throat of a guide plate to direct the leading edge of the sheet between the platen and a set of pressure rollers. Suitable guide plates are usually provided to direct the sheet beneath the platen and for a short distance at the front thereof. As the operator manually rotates the platen, the leading edge of the sheet emerges at the front. However, where the positive guiding ceases, immediately in advance of the printing region, the leading edge of the sheet will tend to separate from the platen, in a direction generally tangential thereto. This free path portion is arranged so that the sheet does not contact the print ribbon, otherwise it would foul the ribbon and cause jamming and possibly also crease the paper and produce smudges on it. Either before or during the manual advancing, the operator will have prepared the paper path for sheet insertion by manually moving a paper hold-down bail bar device, located just above the printing region, so as not to interfere with the leading edge of the incoming sheet. As the bail bar is returned to its platen contacting position the sheet will be moved into intimate contact with the platen for proper printing.

With the advent of unattended impact printers, such as computer terminals, the problem of proper record carrier introduction and feeding has become more complex. One approach has been to provide the record carrier in the form of a continuous web of perforated and sprocketed computer forms to be used in conjunction with a positive tractor feed which drives the continuous sheet to, around and past the platen under the proper tension. While the problem of sheet feeding has been satisfactorily solved by this approach, it has several profound disadvantages. First of all, the mechanism necessitated is expensive. Secondly, the use of the sheets torn from the web is not acceptable for business correspondence since individual sheets will invariably present unsightly edges. Thirdly, as business correspondence usually requires the use of letterhead stock for the first page, followed by plain subsequent pages, the computer forms do not lend themselves to this application, unless the letterhead is produced, as desired, along with the text.

Unattended printers which selectively feed single sheets from a storage cassette and automatically transport them to and around the platen are known. They also comprise complex guidance mechanisms for maintaining the intimate contact between the sheet and the platen. In usage, a sheet is stripped from the stored stack and is transported to the platen. As its leading edge emerges from below the platen and is driven adjacent the hold-down bail bar, the bar is automatically displaced from the platen. Once the sheet lead edge has been sufficiently advanced, the bail bar is automatically returned, to hold the sheet in intimate contact with the platen. The mechanism involved in driving the bail bar adds substantial cost to the printer mechanism.

Another, less satisfactory, solution which has been used in some printers is the provision of a shaped guide plate to hold the paper in position upon the platen. It is clear that this approach requires very critical control of the guide-to-platen gap needed for satisfactory printing. Problems will be encountered if it is desired to print on record carriers over a large range of thicknesses.

The feed system of the present invention satisfactorily solves the foregoing problem of proper record carrier guidance in a unique and inexpensive manner without the formation of slack-producing bulges between the sheet and the platen in the printing region.

In one form, the invention comprises a record carrier feed arrangement for a printer having a rotatable platen when transports the record carrier past a printing region and against which the record carrier is to be urged in intimate contact. The leading edge of the record carrier when fed to the printer and transported by said platen diverges therefrom in the vicinity of the printing region. Rotatable guiding means in the form of a paddle wheel captures the record carrier leading edge as it diverges from the platen, downstream of the printing region, redirects the record carrier toward the platen and urges the record carrier into intimate contact with the platen.

Figure 2:
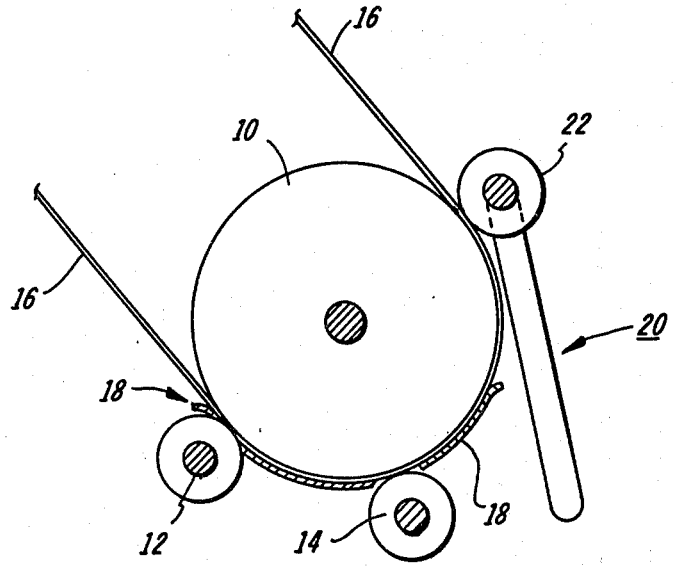
FIG. 2 (PRIOR ART)
Figure 3:
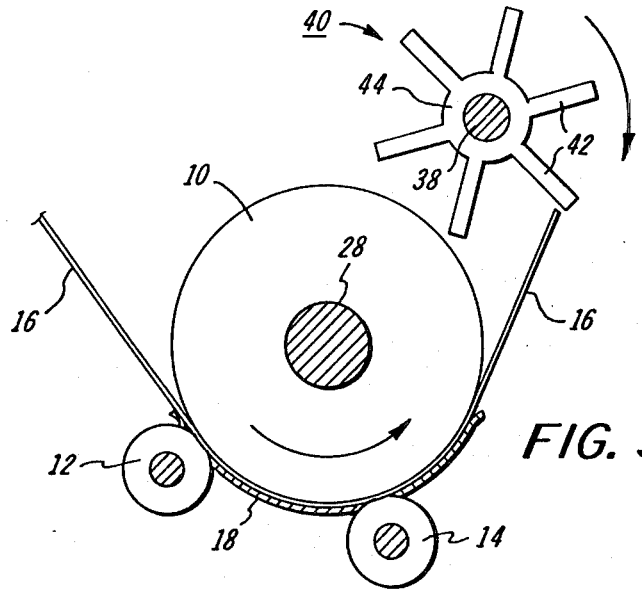
Figure 4:
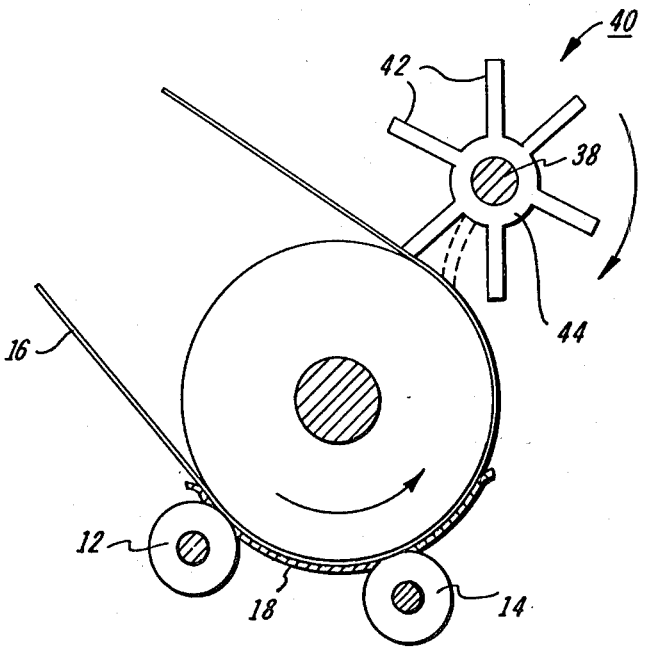
Figure 5:
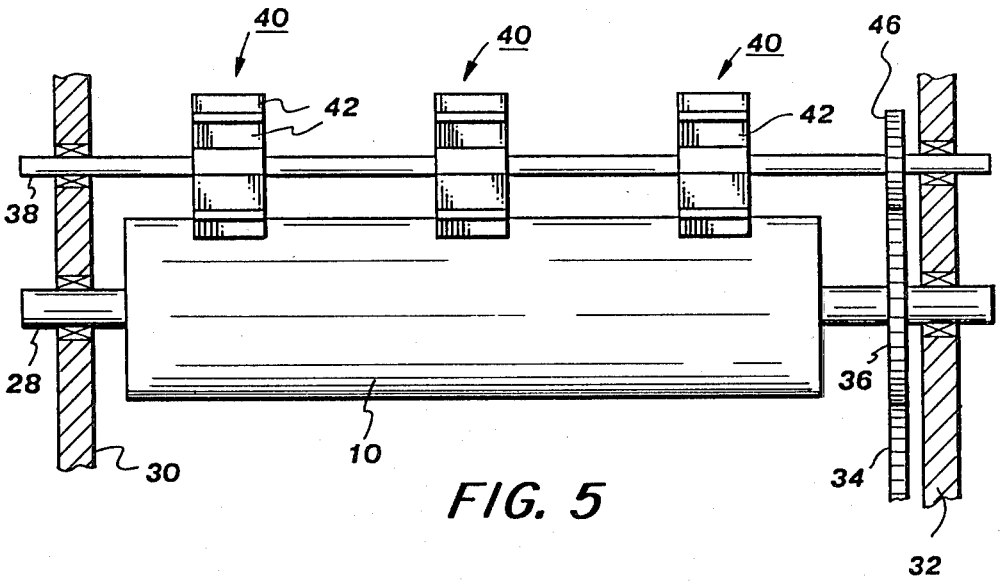
Figure 6:
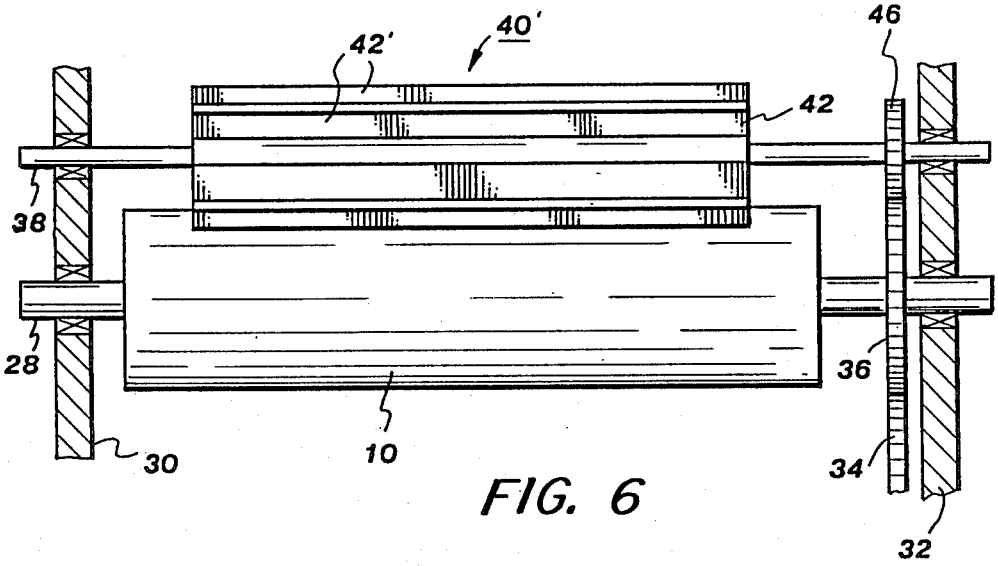

Other objects and advantages of the present invention will be clear from the following decription and claims taken with the accompanying drawings, wherein:

FIG. 1 is a side elevation view of the prior art bail bar in its displaced position, FIG. 2 is a side elevation view of the prior art bail bar in its operative position, FIG. 3 is a side elevation view of the paddle wheel guide of the present invention, shown as it receives a sheet, FIG. 4 is a side elevation view of the paddle wheel guide of the present invention, shown redirecting the sheet lead edge, FIG. 5 is a front elevation view of one form of the paddle wheel guide arrangement and its relation to the platen, and FIG. 6 is a front elevation view of another form of the paddle wheel guide arrangement.

Referring to FIGS. 1 and 2 there is shown the prior art approach to sheet guidance and intimate capture within a printer. A standard printer platen 10 is mounted for rotation in a known manner upon a support shaft journalled in printer side plates. The platen 10 has rear feed roller 12 and front feed roller 14 cooperating therewith to cause a record carrier sheet 16 (shown in phantom lines) to be advanced through the nips 10/12 and 10/14. A formed guide or cradle 18 is spaced from the platen and extends from upstream of rear feed roller 12 to downstream of front feed roller 14. As the sheet lead edge emerges from the downstream portion of cradle 18 the sheet follows a substantially tangential path, departing from the platen. A known paper hold-down bail bar 20 is used to redirect the sheet toward the platen 10 and hold it in intimate contact therewith by means of bail rollers (only one shown) 22 mounted at intervals upon bail shaft 24 which extends substantially parallel to the platen axis. Bail bar support and shifting arm 26 is movable about a pivot, in the direction of the arrow A.

In a typewriter embodiment the operator grasps a portion of the bail bar 20 and moves it into the position shown in FIG. 1 during sheet insertion and then into the position shown in FIG. 2 to drive the sheet into intimate contact with the platen 10, for high quality printing by means of a printing mechanism (not shown). An added degree of machine complexity and expense is introduced when the operator is removed in favor of automatic bail bar movement, as is necessitated in an unattended printer terminal.

In the present invention, the bail bar is completely eliminated. This may be accomplished permanently as is the case of a printer designed in accordance with the present invention, or temporarily, as in the case of a sheet feeder accessory added on to a standard printer. In the latter case, the bail bar will be swung out of the way and will not be utilized at all, as long as the accessory is in place. FIGS. 3 through 6 illustrate the present invention. As the platen 10, feed rollers 12 and 14 and cradle 18 will remain intact, the same numerals are used to identify those elements. The platen is rotatable on shaft 28 journalled for rotation in printer side plates 30 and 32. A suitable driving arrangement such as gear train 34, 36 will advance the platen by the desired increments during the record carrier sheet insertion and during the printing operation.

The novel guiding member of this invention is mounted above the platen 10, upon shaft 38 which may be also journalled in printer side plates 30 and 32. Of course, if the guiding member is an integral part of an add-on accessory feeder the shaft 38 would be journalled in the side plates of the accessory device. The guiding member comprises a paddle wheel 40 having a plurality of circumferentially spaced fingers or blades 42 made of a flexible material, such as an elastomer, extending radially outwardly from a hub 44. The paddle wheel may be integrally molded with the hub 44 and blades 42 as a unitary element or the blades 42 may be fitted into slots provided in the hub 44. Alternatively, the blades may comprise tufts of flexible bristles or any other functionally equivalent wiping member.

As illustrated in FIG. 5 a number of short paddle wheels elements 40 may be used, while in FIG. 6 a single elongated paddle wheel element 40′ having blades 42′, is shown. Either embodiment may operate satisfactorily. A drive arrangement for the paddle wheel may be simply effected by mounting a suitable spur gear 46 on shaft 38 and adding it to the gear tain 34, 36. By properly selecting the spur gear 44 the shaft 38 and paddle wheel elements 40 or 40′ may be driven at the desired speed relative to the platen 10. Preferably, the paddle wheel is driven at a slightly faster speed than the platen to enhance the wiping action and to insure that there are no bulges between the record carrier sheet and the platen.

In operation, as illustrated in FIGS. 3 and 4, the leading edge of the record carrier sheet 16 is advanced between feed rollers 12 and 14 and platen 10 and emerges from cradle 18 in a direction departing from the platen. The leading edge will be driven toward a side wall of a blade 42 of paddle wheel 40 where it will be captured between a pair of adjacent blades. As the sheet continues to be driven and the paddle wheel continues to rotate, the sheet will be swept along with the moving blade 42 and will be redirected back to the platen 10. The shafts 28 and 38 are located so that there will be a slight interference between the extended blade 42 and platen 10. As the platen and paddle wheel element continue to rotate, the blade will deform (as shown in dotted lines in FIG. 4) driving and wiping the sheet into intimate contact with the platen and removing all bulges or spaces between the sheet and the platen.

In order to insure that the sheet will be constantly held in place, it may be desirable to place more blades than illustrated on the paddle wheel so that there will be constant wiping contact between at least one blade and the platen. Alternatively, in the plural paddle wheel element embodiment of FIG. 5, the wheels may be shifted one relative to the other so that there always will be contact by at least one blade on one wheel against the platen. In the FIG. 6 embodiment this may be accomplished if necessary by forming the blades 42′ along a slight spiral upon the hub.

While the invention has been particularly shown and described with reference to several embodiments thereof, it will be understood by those skilled in the art that various changes in the form and details may be made therein without departing from the spirit and scope of the invention.

What is claimed is:

1. A record carrier feed arrangement for a printer having a platen rotatable about a first axis for serially transporting record carrier sheets past a printing region and against which each record carrier sheet is to be urged in intimate contact, wherein the leading edge of the record carrier sheet, when transported by said platen, diverges therefrom in the vicinity of said printing region, said feed arrangement being characterized by including guiding means rotatable about a second axis, said guiding means comprising a set of peripherally spaced resilient members, extending outwardly from said axis, between which the record carrier leading edge may be captured, by which it may be redirected toward said platen as it diverges from said platen, downstream of said printing region, and by which it may be urged into intimate contact with said platen, said first and second axes being fixed relative to one another and being positioned so that the ends of said peripherally spaced members blades interfere with the surface of said platen.

2. The record carrier feed arrangement as defined in claim 1 characterized in that said second axis is substantially parallel to and spaced from said first axis.

3. The record carrier feed arrangement as defined in claim 1 characterized in that said guiding means comprises plural sets of peripherally spaced resilient members in axially spaced relationship to one another.

4. The record carrier feed arrangement as defined in claim 2 characterized in that said peripherally spaced members are substantially coextensive with said platen.

5. The record carrier feed arrangement as defined in claim 2 or 3 characterized in that said peripherally spaced members are driven in a direction opposite to the direction of said platen.

6. The record carrier feed arrangement as defined in claim 5 characterized in that said peripherally spaced members are driven at a rate faster than the rate of said platen.

* * * * *